US005792986A

United States Patent [19]

Lee

[11] Patent Number: 5,792,986

[45] Date of Patent: Aug. 11, 1998

[54] COMPOSITE AUDIO/VIDEO CABLE ASSEMBLY

[75] Inventor: Noel Lee, Daly City, Calif.

[73] Assignee: Monster Cable International, Ltd., Hamilton, Bermuda

[21] Appl. No.: 783,697

[22] Filed: Jan. 15, 1997

Related U.S. Application Data

[63] Continuation of Ser. No. 368,887, Jan. 5, 1995, abandoned.

[51] Int. Cl.[6] ..... H01R 11/00

[52] U.S. Cl. ..... 174/72 A; 174/68.1; 439/502

[58] Field of Search ..... 174/71 R, 72 C, 174/72 A, 69, DIG. 8, 68.1; 439/439, 502, 623

[56] References Cited

U.S. PATENT DOCUMENTS

| | | | |
|---|---|---|---|
| 2,748,359 | 5/1956 | Swan | 439/502 |
| 4,632,121 | 12/1986 | Johnson et al. | 439/502 X |

FOREIGN PATENT DOCUMENTS

| | | | |
|---|---|---|---|
| 0094270 | 4/1990 | Japan | 439/502 |
| 0473497 | 7/1969 | Switzerland | 174/DIG. 8 |
| 92-00623 | 1/1992 | WIPO | 174/72 A |

OTHER PUBLICATIONS

"Cho–Shrink Heat Shrinkable connector Boots", Nov. 17, 1969, Technical Bulletin 33.

"Heat Shrink Products", Feb. 1970, American Pamcor, Inc. pp. 1–10.

*Primary Examiner*—Hyung S. Sough

*Attorney, Agent, or Firm*—Haynes and Boone, L.L.P.

[57] ABSTRACT

A cable assembly including a plurality of cables for connecting to at least one output source and a plurality of cables for connecting to at least one input source. A first junction member is electrically and mechanically connected to the input cables and a second junction member is electrically and mechanically connected to the output cables. A single-sheathed cable is connected between the first and second junction members for electrically connecting the input cables to the output cables, respectively.

5 Claims, 2 Drawing Sheets

COMPOSITE AUDIO/VIDEO CABLE ASSEMBLY

This is a continuation of application Ser. No. 08/368,887 filed on Jan. 5, 1995, now abandoned.

BACKGROUND OF THE INVENTION

The invention relates to a composite audio/video cable assembly, and, more particularly, to a cable assembly including a plurality of individual cables for connecting in a audio/video installation.

Merging video systems with high quality audio system s is becoming increasingly popular. In these installations, several output, or program, sources are available, such as laser disc players, stereo video cassette recorders (VCRs), and satellite receivers, all of which have a video output and two (left and light) audio outputs. These outputs are usually connected to an input source such as a stereo receiver, amplifier, preamplifier, processor or decoder (hereinafter referred to as "receiver"), which performs switching and processing functions and which includes a power amplifier, or an output to a power amplifier, for driving loudspeakers. The video output of the receiver is then routed to a televisio n monitor, or the like, having a video input. (Alternately, the video output signal could be routed directly to the television monitor in systems in which video switching among multiple sources is not needed).

The audio and video outputs of each of the above-mentioned program sources, as well as the corresponding inputs of the receiver, each receive a coaxial connector, often termed a "RCA" connector, which is standard in the industry. Thus, three cables, each provided with a connector at each end, are connected between the program source and the receiver. Still additional cables are needed when one of the program sources, such as a satellite receiver or laser disc player is connected to the input of a VCR for recording the video and audio signals, and the output of the VCR is connected to the receiver. In high quality installations, these cables are usually relatively large in diameter and, in many installations, they must be relatively long.

It can be appreciated with several program sources connected in the above manner, a multitude of cables are required which, along with speaker wires, AC power cords and antenna cables, result in a maize of cables, wires and cords which renders it difficult, if not impossible, to identify the cables and maintain a neat and organized installation.

SUMMARY OF THE INVENTION

It is therefore an object of the present invention to provide a cable assembly which provides for multiple connections yet considerably reduces the number and sizes of the cables.

It is a further object of the present invention to provides a cable assembly of the above type which simplifies the connections and permits the cables to be easily identified and neatly installed and organized.

Towards the fulfillment of these and other objects, the cable assembly of the present invention includes a plurality of cables for connecting to at least one output source and a plurality of cables for connecting to at least one input source. A first junction member is electrically and mechanically connected to the input cables and a second junction member is electrically and mechanically connected to the output cables. A single-sheathed cable is connected between the first and second junction members for electrically connecting the input cables to the output cables, respectively.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figures 1, 2:
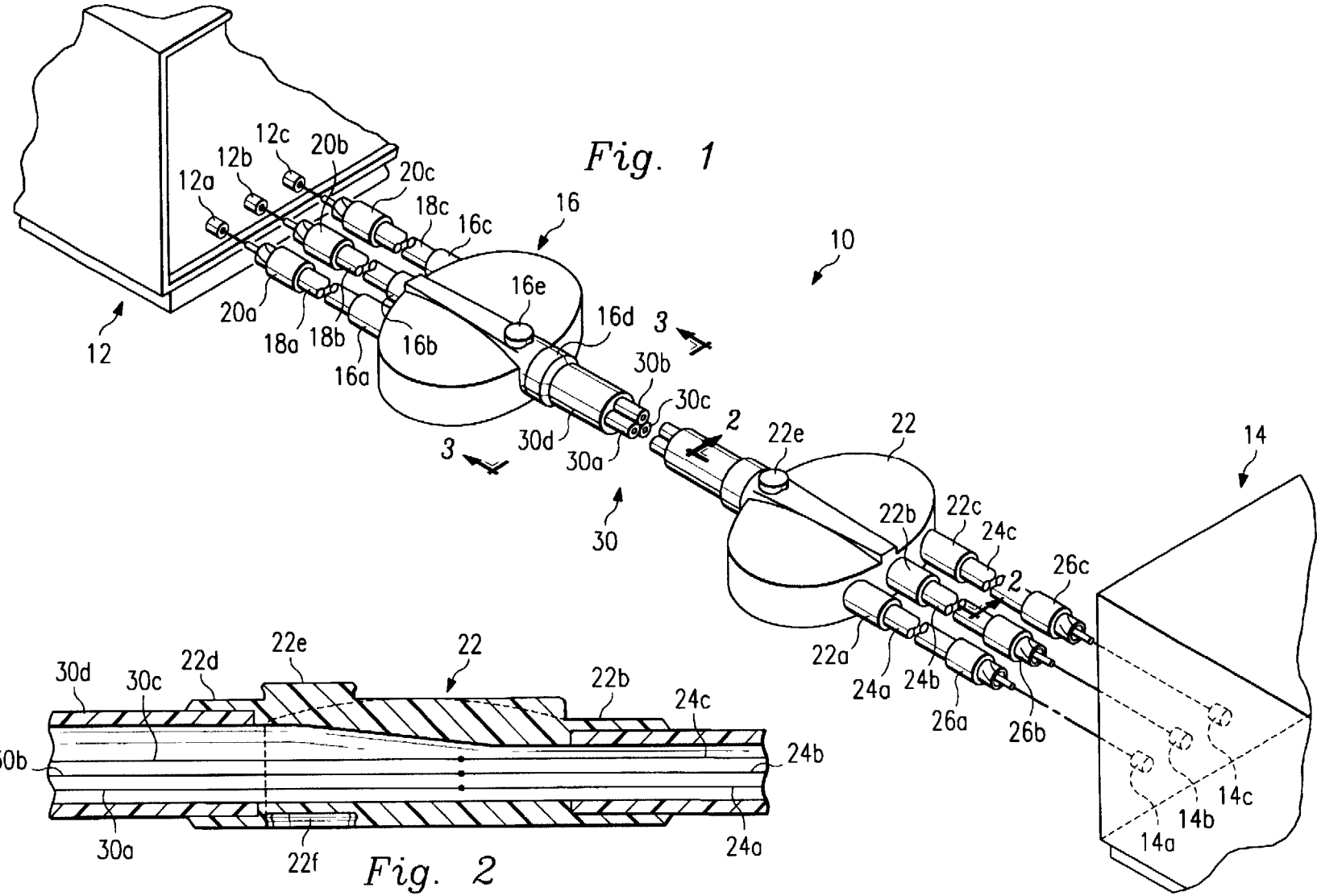
FIG. 1 is a perspective view of the cable assembly of the present invention.
FIGS. 2 and 3 are sectional views taken along the lines 2—2 and 3—3, respectively of FIG. 1.

The cable assembly of the present invention is referred to, in general, by the reference numeral 10 and is shown connecting an output source 12 to an input source 14. The output source 12 could be a laser disc player, a stereo VCR, or a satellite receiver, each of which has a single video output terminal, or jack, **12*a*, and two (left and right) stereo audio output terminals 12*b* and 12*c*, respectively. The input source 14 could be a stereo receiver, amplifier, preamplifier, processor or decoder, each of which has a video input 14*a*, and two stereo audio inputs 14*b* and 14*c***.

The cable assembly 10 includes a junction housing, or "pod" 16, preferably of a molded soft plastic, having three cables **18*a*, 18*b* and 18*c* extending from one end thereof. Each cable 18*a*–18*c*** is of a conventional design that will be described in detail later and includes two conductors (not shown) for respectively carrying the positive and negative portions of the signal.

The cables **18*a*, 18*b* and 18*c* have connectors 20*a*, 20*b* and 20*c* respectively connected to their distal ends, with the connectors being of a standard configuration, such as a "RCA" design, and being adapted to engage the corresponding terminals 12*a*, 12*b* and 12*c*, respectively provided on the output source 12. Thus, the cable 18*a* would receive the video signal and the cables 18*b* and 18*c*** would receive the two (left and right) audio signals.

In a similar manner, a pod 22 is provided which has three cables **24*a*, 24*b* and 24*c* extending from one end thereof, with the cables also being of a conventional design to be described. Three connectors 26*a*, 26*b* and 26*c* are respectively connected to the distal ends of the cables 24*a*, 24*b* and 24*c* for engaging the corresponding terminals 14*a*, 14*b* and 14*c*, respectively, on the input source 14. Thus, the terminal 14*a* would receive the video signal from the cable 24*a* via the connector 26*a*, and the terminals 14*b* and 14*c* would receive the two (left and right) audio signals from the cables 24*b* and 24*c* via the connectors 26*b* and 26*c***, respectively.

As shown in FIG. 1, the pods 16 and 22 are connected together by an assembly 30 which includes three cables **30*a*, 30*b* and 30*c* which are preferably of a smaller diameter than the cables 18*a*–18*c* and 24*a*–24*c*. The cables 30*a*–30*c* are in a "stacked", abutting relationship and, as better shown in FIG. 2 are surrounded by a single outer sheath 30*d*** of insulative material.

According to a preferred embodiment, the cables **18*a*–18*c* and 24*a*–24*c*** are of a coaxial type consisting of a central conductor for carrying the positive portion of the signal, a braided conductor surrounding, and insulated from, the central conductor for carrying the negative portion of the signal, and an outer sheath of insulative material. Since this is a conventional configuration, it will not be described in any further detail.

As better shown in FIG. 2 the pod 22 (and the pod 16 which is identical) is formed by a housing of insulative material having a hollow interior which receives corresponding end portions of the cables 30a–30c and 24a–24c. As shown schematically in FIG. 2 for the convenience of presentation, the cable 30a is connected to the cable 24a, the cable 30b is connected to the cable 24b and the cable 30c is connected to the cable 24c, all in the interior of the pod 22. These connections are made in any known manner such as by forming the cables 30a, 30b and 30c integrally with their respective cables 24a, 24b, and 24c, or by soldering the respective ends of the cables, etc. It is understood that the other end portions of the cables 30a–30c as well as the corresponding end portions of the cables 18a–18c are connected in the interior of the pod 16 in a similar manner. Thus, the cable 30a connects the cable 18a to the cable 24a, the cable 30b connects the cable 18b to the cable 24c, and the cable 30c connects the cable 18c to the cable 24c. The signals from the output source 12 are thus transferred from the cables 18a–18c to the cables 24a–24c via the cables 30a–30c, and from the cables 24a–24c to the input source 14.

According to one of the features of the present invention, three sleeves 22a, 22b and 22c extend outwardly from one end of the pod 22 and preferably are formed by the same insulative material that forms the housing of the pod 16. The sleeves 22a, 22b and 22c extend over and are preferably extruded over, the outer insulative sheaths of each of the cables 24a–24c, respectively. In a similar manner, a sleeve 22d extends from the other end of the pod 22 and over the corresponding end of the cable 30. The pod 16 has sleeves 16a, 16b and 16c extending from one end thereof which are extruded over the cables 18a, 18b and 18c, respectively; as well as a sleeve 16d extending from the other end thereof which is extruded over the corresponding end of the cable 30. This creates a unitary assembly, the advantages of which will be discussed later.

As shown in FIGS. 1 and 2, the pods 16 and 22 are provided with nipples, or circular flanges 16e and 22e, respectively, which project from their upper surfaces. As shown in FIG. 2 in connection with the pod 22, a circular recess 22f is provided in the lower portion thereof, it being understood that a similar recess is provided on the pod 16. These flanges and recesses are adapted to extend in, and receive, respectively, corresponding recesses and flanges of other pods of other similar cable assemblies in a friction fit. Therefore, in the event one or more additional assemblies 10 are needed in the same installation, their respective pods can be stacked and secured, to facilitate a neat and orderly installation.

Figure 4:
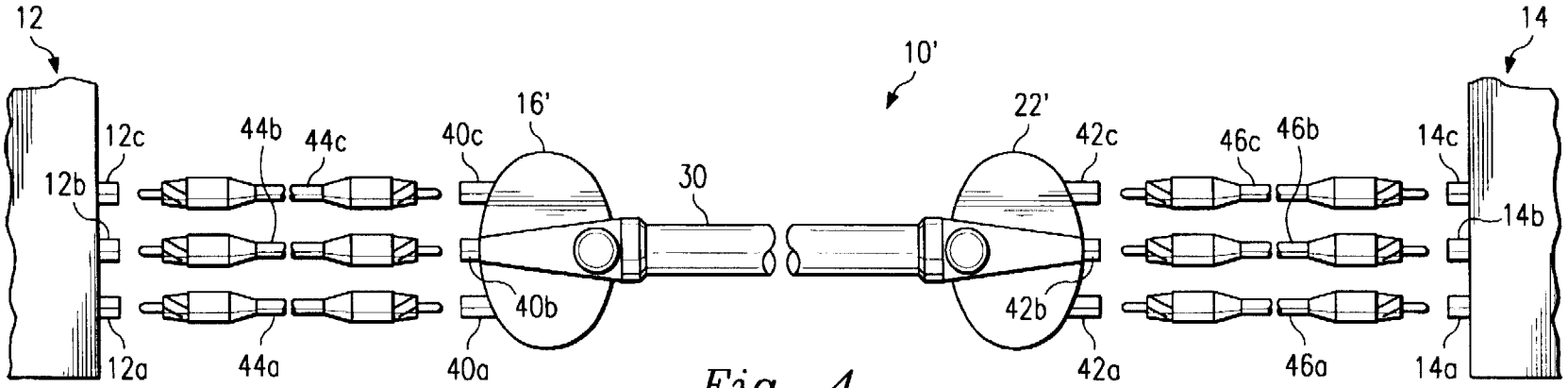
FIG. 4 is a view similar to FIG. 3 but depicting an alternative embodiment of the present invention.

An alternate embodiment of the present invention is shown in FIG. 4, with identical components thereof being given the same reference numerals as the cable assembly 10. According to the embodiment of FIG. 4, a cable assembly 10' is provided which includes a pod 16' provided with three terminals, or jacks, 40a, 40b, and 40c; and a pod 22' provided with three terminals, or jacks, 42a, 42b, and 42c.

Figure 3:
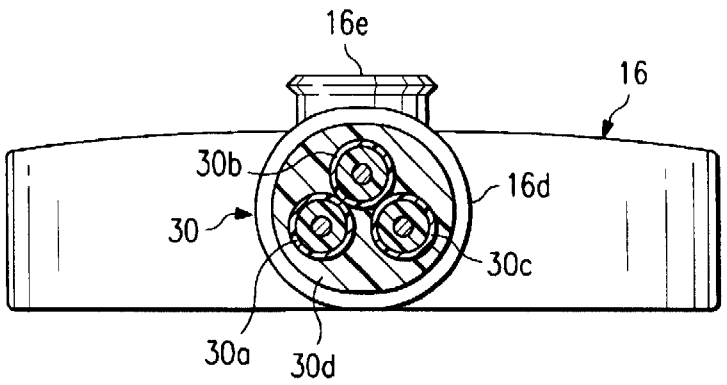

The jacks 40a, 40b and 40c are adapted to be connected to the output source 12 by three separate cables 44a, 44b and 44c, and the jacks 42a, 42b and 42c are adapted to be connected to the input source 14 by three separate cables 46a, 46b and 46c, respectively. The cables 44a, 44b, 44c, 46a, 46b and 46c are of the type described above with the exception that they each have a connector, identical to the connectors 20a–20c and 26a–26c in the previous embodiment, connected to each end thereof. Thus, the video output 12a of the output source 12 is connected to the video input 14a of the input source 14 through the cable 44a, the cable 30a and the cable 46a; while the two audio outputs 12b and 12c of the source 12 are connected to the two audio inputs 14b and 14c, respectively, of the source 14 by the cables 44b and 44c, the cables 30b and 30c, and the cables 46b and 46c, respectively. Otherwise, the embodiment of FIG. 4 is identical to that of FIGS. 1-3.

The cable assembly 10 thus eliminates the need for three, relatively bulky cables extending between the sources 12 and 14, yet provides for multiple connections. Also, it enables the size of the cables to be reduced and simplifies the connections, while permitting the cables to be easily identified and neatly installed and organized. Further, the sleeves 16a–16d of the pod 16 and the sleeves 22a–22d of the pod 22 protect the electrical conductors contained therein against bending stresses. The embodiment of FIG. 4 provides all of the advantages of the embodiment of FIGS. 1–3 while enabling installers to use separate cables of their own choosing between the cable assembly 10 and the two sources 12 and 14.

It is understood that several variations may be made in the foregoing without departing from the scope of the invention. For example, the sleeves 16a–16d and 22a–22d of the pods 16 and 22, respectively, can be molded integrally with the insulative material of the cables 18a–18c, 24a–24c and 30. Also, the output source 12 and the input source 14 could have only one audio output in which case the cable assembly 10 would have two input cables and two output cables. Also, a jack can be provided on the pods 16 and 22 which receives a connector disposed at the respective ends of the cable 30, so that the latter cable can be selected by the installer, in a manner similar to that disclosed in connection with the cables 44a–44c and 48a–48c in the embodiment of FIG. 4. Further, the video output terminal 12a of the output source 12 could be connected directly to a video monitor and not connected to the input terminal 14a of the source 14. Still further, it is understood that the connectors 20a–20c and 26a–26c of the embodiment of FIGS. 1–3, and the corresponding connectors in the embodiment 4, are not limited to RCA connectors but can other types such as balanced (XLR), or the like. Still further, the electrical conductors of the cables 30a–30d can be formed integrally with the electrical conductors of the cables 18–18c and 24a–24c, respectively.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A cable assembly comprising:

a plurality of cables extending in a closely-spaced, parallel relationship, each of the cables comprising an electrical conductor and an insulative material surrounding the conductor; and an insulating assembly formed of insulating material and extending over a portion of the cables, the insulating assembly comprising:

a first housing of an insulative material extending over a section of the cables and having a top surface with a nipple and a bottom surface with a circular recess, and a second housing of an insulative material extending over another section of the cables and in a spaced relation to the first housing, the second housing having a top surface with a nipple and a bottom surface with a circular recess, and a first portion of the cables projecting from the first housing, a second portion of the cables projecting from the second housing, and a third portion of the cables extends between the housings, a plurality of insulative sheaths respectively extending around the first portion of the cables, a plurality of insulative sheaths respectively extending around the second portion of the cables, and a single insulative sheath surrounding the cables extending between the housings.

2. The assembly of claim 1 wherein the insulative material forming the first and second housings is extruded over corresponding end portions of the insulative sheaths of the first and second cable portions.

3. The assembly of claim 1 wherein the insulative material forming the first and second housings is extruded over respective end portions of the single insulative sheath.

4. The cable assembly of claim 1 wherein the insulating assembly is formed by one piece of insulating material.

5. The cable assembly of claim 1 wherein the nipples and the recesses permit the housings to be secured when stacked relative to housings of similar cable assemblies.

* * * * *